US007731544B2

(12) United States Patent
Ma et al.

(10) Patent No.: US 7,731,544 B2
(45) Date of Patent: Jun. 8, 2010

(54) U-SHAPED ELECTRICAL CONNECTOR SPRING DEVICES AND METHODS

(75) Inventors: JianFeng Ma, ShenZhen (CN); Peixian Hu, ShenZhen (CN)

(73) Assignee: BizLink Technology, Inc., Fremont, CA (US)

( * ) Notice: Subject to any disclaimer, the term of this patent is extended or adjusted under 35 U.S.C. 154(b) by 0 days.

(21) Appl. No.: 12/101,848

(22) Filed: Apr. 11, 2008

(65) Prior Publication Data

US 2008/0280506 A1 Nov. 13, 2008

(30) Foreign Application Priority Data

May 8, 2007 (CN) ..... 2007 2 0119974

(51) Int. Cl.
*H01R 33/00* (2006.01)

(52) U.S. Cl. ..... 439/698; 439/830; 439/858

(58) Field of Classification Search ..... 439/698, 439/830, 858, 723, 724
See application file for complete search history.

(56) References Cited

U.S. PATENT DOCUMENTS

| | | | | | |
|---|---|---|---|---|---|
| 2,240,658 | A | * | 5/1941 | Mathern | 439/858 |
| 3,977,753 | A | * | 8/1976 | Fournier | 439/830 |
| 4,266,845 | A | | 5/1981 | Ishikawa | |
| 4,451,109 | A | * | 5/1984 | Inoue | 439/830 |
| 4,491,382 | A | | 1/1985 | Ishikawa | |
| 4,669,808 | A | * | 6/1987 | Owen | 439/858 |
| 4,699,444 | A | | 10/1987 | Isohata | |
| 4,872,262 | A | * | 10/1989 | Marach | 29/884 |
| 4,895,531 | A | | 1/1990 | Vignoli | |
| 4,938,708 | A | * | 7/1990 | Vigneau et al. | 439/239 |
| 4,950,183 | A | | 8/1990 | Watanabe | |
| 5,536,186 | A | | 7/1996 | Watanabe | |
| 6,062,918 | A | | 5/2000 | Myer | |
| 6,326,878 | B1 | * | 12/2001 | Liang | 337/215 |
| 6,712,641 | B2 | | 3/2004 | Beege | |
| 6,746,286 | B2 | | 6/2004 | Blaha | |
| 6,796,855 | B2 | | 9/2004 | Fricke | |
| 6,994,566 | B2 | | 2/2006 | You | |
| 2007/0259577 | A1 | | 11/2007 | Stromiedel | |
| 2008/0254688 | A1 | * | 10/2008 | Bogursky et al. | 439/858 |

* cited by examiner

*Primary Examiner*—Hien Vu
(74) *Attorney, Agent, or Firm*—Law Office of Andrei D. Popovici, PC

(57) ABSTRACT

According to some embodiments, an electrical connection assembly comprises a conductive support having a pair of longitudinal conductive slots for receiving a corresponding pair of longitudinal conductive pins; and a U-shaped conductive spring coupled to the conductive support. The conductive spring comprises a pair of conductive longitudinal spring sides each aligned with a corresponding longitudinal conductive slot, and a spring top plate interconnecting the spring sides along corresponding top regions of the spring sides. Each spring side has a pair of parallel longitudinal slots defined therein. The longitudinal slots separate an outer perimeter section of the spring side from a central section of the spring side. The central section includes a contact tab configured to establish contact with a longitudinal conductive pin. The central section further includes an inward-bending support tab configured to press a bottom part of the outer perimeter section outward to establish contact with the conductive pin.

5 Claims, 3 Drawing Sheets

U-SHAPED ELECTRICAL CONNECTOR SPRING DEVICES AND METHODS

RELATED APPLICATION DATA

This application is based upon and claims the benefit of priority from prior Chinese Patent Application No. 200720119974.7, filed May 8, 2007, which is herein incorporated by reference.

BACKGROUND

The present invention relates to electrical connection devices and methods, and in particular to conductive U-shaped spring devices and methods for connection of electrical components.

Common solar energy junction boxes enclose a number of electrical components. Connection of components inside such boxes may use solder or pullback-style flexible piece compression connections. Solder connections may be relatively firm, but may be hard to repair. Also, replacing damaged soldered components may require the use of a soldering iron to remove the damaged electronic component and then to solder on the replacement component. In such a case, repairing a junction box may require specialized personnel, and may be time-consuming and inconvenient. Pullback-style pressure connections may be more convenient, but may provide limited contact areas and thus limited current transmission capabilities.

SUMMARY

According to one aspect, an electrical connection assembly comprises a conductive support having a pair of longitudinal conductive slots for receiving a corresponding pair of longitudinal conductive pins; and a U-shaped conductive spring coupled to the conductive support. The conductive spring comprises a pair of conductive, generally longitudinal spring sides each aligned with a corresponding longitudinal conductive slot, and a spring top plate interconnecting the spring sides along corresponding top regions of the spring sides. Each spring side has a pair of parallel longitudinal slots defined therein. The longitudinal slots separate an outer perimeter section of each spring side from a central section of the spring side. The central section includes a contact tab configured to establish contact with a longitudinal conductive pin.

According to another aspect, an electrical connection method comprises aligning a conductive, generally-longitudinal side of a U-shaped conductive spring with a corresponding longitudinal conductive slot of a conductive support, the spring side having a pair of parallel longitudinal slots defined therein, the longitudinal slots separating an outer perimeter section of the spring side from a central section of the spring side, the central section including a contact tab; and inserting a longitudinal conductive pin of an electronic component in the longitudinal slot to establish an electrical contact between the longitudinal conductive pin and the contact tab and outer perimeter section of the spring side.

According to another aspect, a U-shaped electrical connector spring comprises a pair of conductive, generally longitudinal spring sides, and a spring top plate interconnecting the spring sides along corresponding top regions of the spring sides. Each spring side has a pair of parallel longitudinal slots defined therein. The longitudinal slots separate an outer perimeter section of the spring side from a central section of the spring side. The central section includes a contact tab configured to establish contact with an external longitudinal conductive pin.

BRIEF DESCRIPTION OF THE DRAWINGS

The foregoing aspects and advantages of the present invention will become better understood upon reading the following detailed description and upon reference to the drawings where.

DETAILED DESCRIPTION OF PREFERRED EMBODIMENTS

In the following description, it is understood that any recitation of an element refers to at least one element. A set of elements includes one or more elements. A plurality of elements includes two or more elements. Each recited element/structure can be formed by or be part of a monolithic structure, or be formed from multiple distinct structures. A recitation of two distinct elements does not exclude the two elements forming different parts of a single monolithic structure. Directional terms such as "over" and "under" refer to relative positions between recited elements, are not limited to specific directions defined with respect to the direction of gravity.

Figure 1:
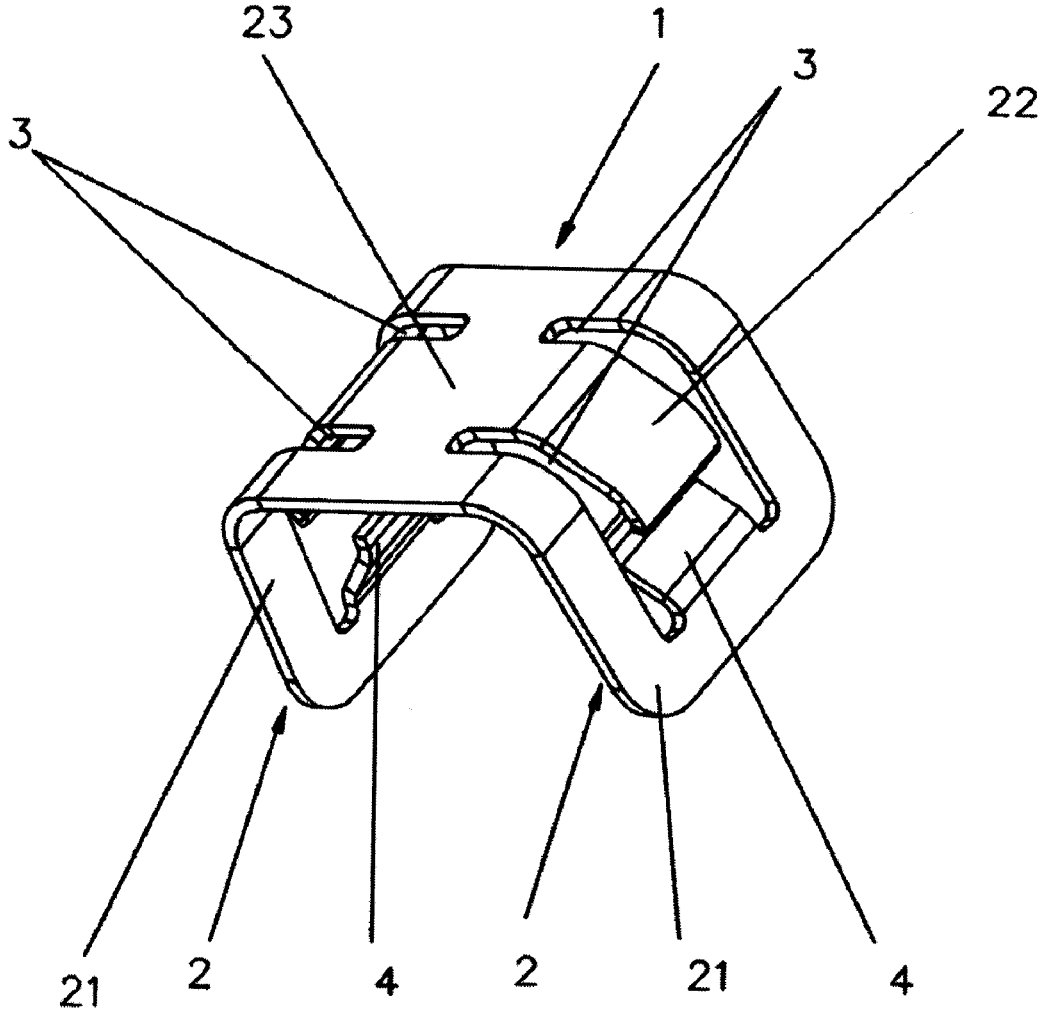
FIG. 1 shows a conductive U-shaped connection spring according to some embodiments of the present invention.

FIG. 1 shows a U-shaped spring 1 suitable for connecting electronic components, according to some embodiments of the present invention. Spring 1 includes two generally-longitudinal, opposing spring sides (side walls) 2 connected by a top plate 23. Two elongated, parallel longitudinal slots 3 are formed along each of the two opposing side walls 2. Each side wall 2 is divided by its corresponding longitudinal slots 3 into an outer (perimeter) flexible section 21 and a central flexible section including a flexible upper contact tab 22 and an inward-bending lower support tab 4. A longitudinal conductive pin of an electronic component establishes electrical contact with spring 1 along the outer end of contact tab 22 and along the bottom transverse strip of outer section 21, which is pushed outward by a spring-compression force exerted by support tab 4, as described below.

Figure 2:
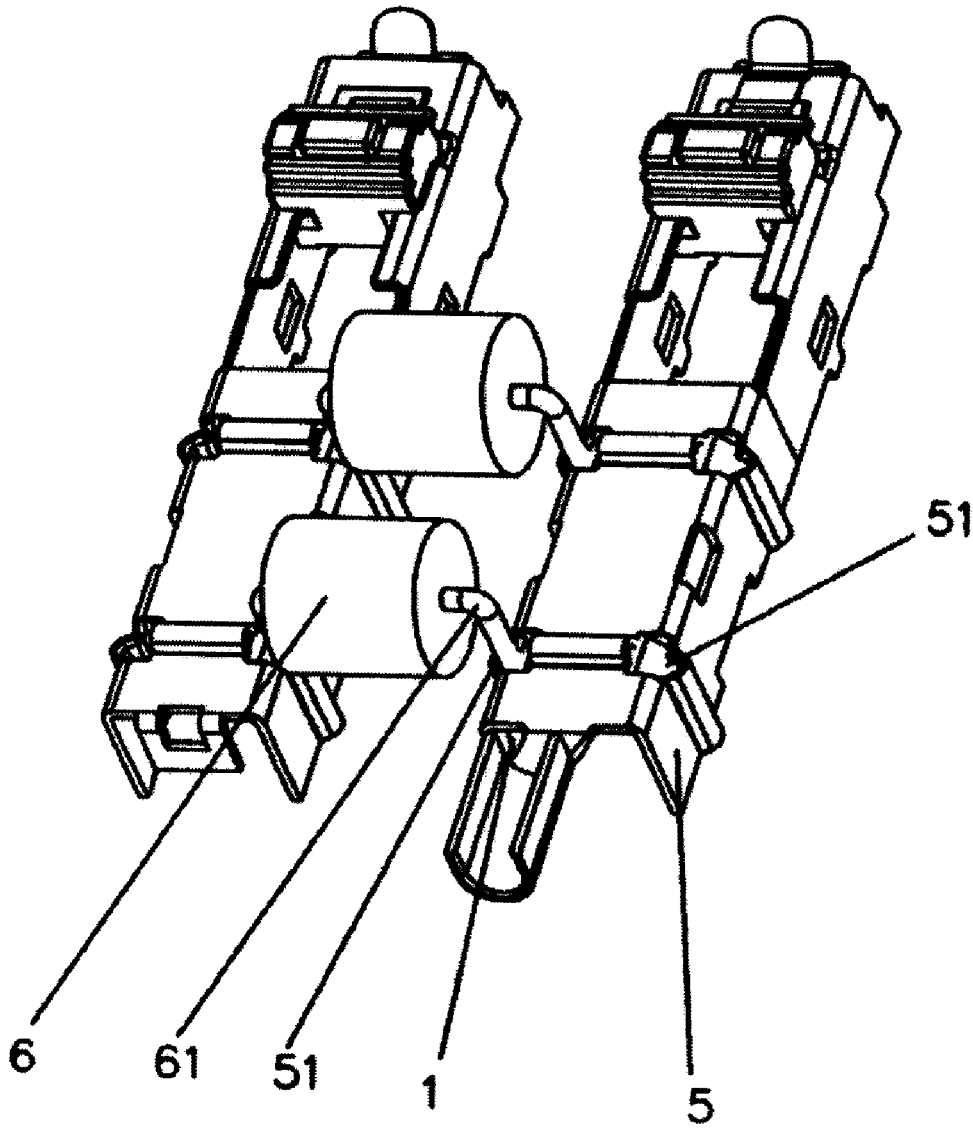
FIG. 2 shows a connection assembly including four connection springs such as the one shown in FIG. 1, according to some embodiments of the present invention.
Figure 3:
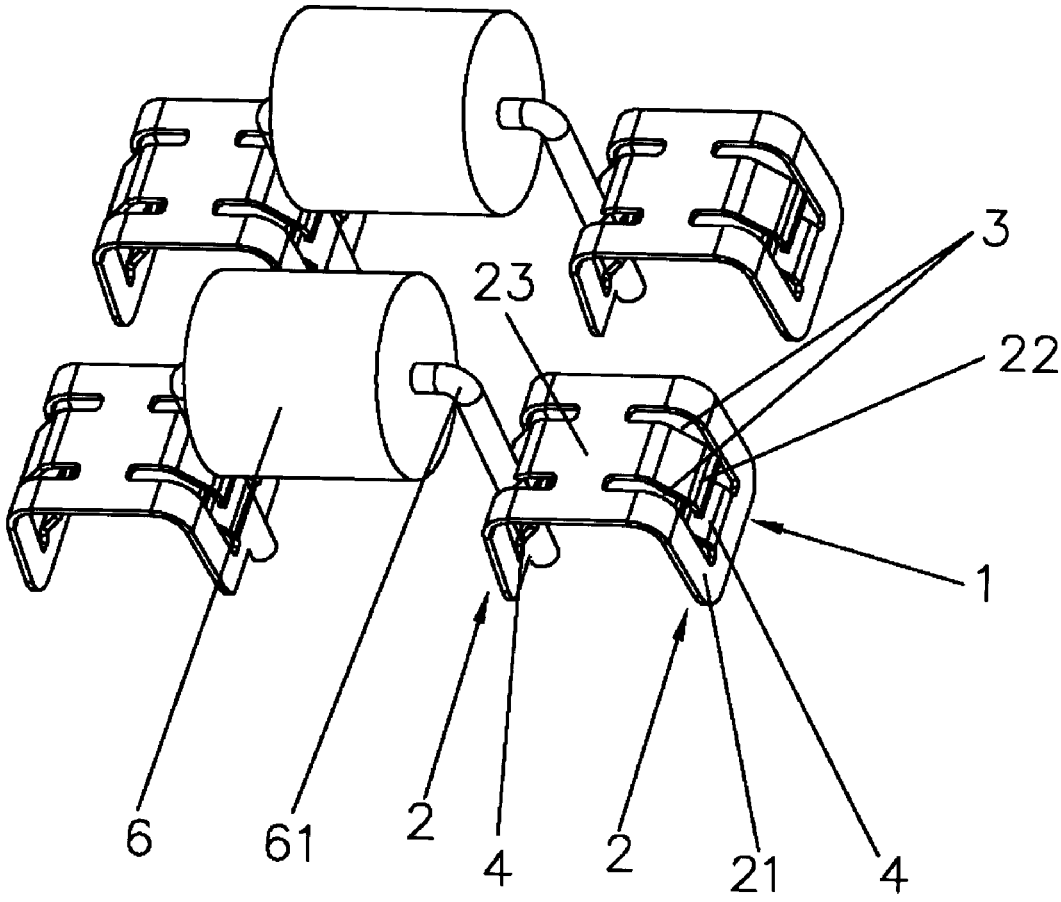
FIG. 3 shows part of the connection assembly of FIG. 2 including two electronic components each connected between a pair of connection springs such as the one shown in FIG. 1, according to some embodiments of the present invention.

FIG. 2 shows a connection assembly including a U-shaped conductive support 5 and four springs 1 disposed within conductive support 5, according to some embodiments of the present invention. FIG. 3 shows the assembly of FIG. 2 with conductive support 5 removed, according to some embodiments of the present invention. Each spring 1 fits within a U-shaped groove defined within conductive support 5, with each outer spring section 21 and contact tab 22 aligned with a longitudinal slot 51 defined within conductive support 5. Each longitudinal slot 51 has an arcuate transverse cross-section. An electronic component 6 such as a diode includes conductive connection pins 61. Each pin 61 is inserted into a corresponding longitudinal slot 51, and is held between the inner wall of slot 51 and the outer surface of flexible section 21 and contact tab 22. Both flexible section 21 and contact tab 22 are spring-compressed onto the pin 61, allowing an improved electrical contact between spring 1 and pins 61.

The connection assembly of FIG. 2 is slipped into a slot (not illustrated) inside a junction device. Support tabs 4 are supported on the inside along a base surface of the slot, and compel outer spring section 21 to more forcefully press pins 61 toward conductive support 5. The pressure provided by support tabs 4 improves the quality of the contact between conductive pins 61 and conductive support 5 and spring 1.

The exemplary devices and methods described above allow establishing electrical connections for electronic component with improved clamping/contact characteristics. The side-surface longitudinal slots of the described U-shaped conductive springs define dual flexible spring elements, which may flex substantially independently of each other. The inward-bending support tab presses the bottom edge of the spring outward. During operation, the spring force exerted by the contact tab does not adversely affect the normal operation of the outer spring section, and conversely the spring force exerted by the outer spring section does not adversely affect the normal operation of the contact tab. The two spring elements are simultaneously spring-compressed onto the electronic component conductive pins.

It will be clear to one skilled in the art that the above embodiments may be altered in many ways without departing from the scope of the invention. Accordingly, the scope of the invention should be determined by the following claims and their legal equivalents.

What is claimed is:

1. An electrical connection assembly comprising:

a conductive support having a pair of longitudinal conductive slots for receiving a corresponding pair of longitudinal conductive pins of at least one electronic component; and a U-shaped conductive spring coupled to the conductive support, the conductive spring comprising a pair of conductive, generally longitudinal spring sides each aligned with a corresponding longitudinal conductive slot, each spring side having a pair of parallel longitudinal slots defined therein, the longitudinal slots separating an outer perimeter section of said each side from a central section of said each side, the central section including a contact tab configured to establish contact with a longitudinal conductive pin, wherein the contact tab and the outer perimeter section are capable of flexing substantially independently of each other to establish electrical contact between the conductive spring and the longitudinal conductive pin along the contact tab and a bottom part of the outer perimeter section, and wherein said each spring side comprises an inward-bending support tab configured to press the bottom part of the outer perimeter section outward to establish contact with the longitudinal conductive pin; and a spring top plate interconnecting the spring sides along corresponding top regions of the spring sides.

2. An electrical connection method comprising:

aligning a U-shaped conductive spring having a pair of generally-longitudinal sides with a corresponding longitudinal conductive slot of a conductive support, each spring side having a pair of parallel longitudinal slots defined therein, the longitudinal slots separating an outer perimeter section of said each spring side from a central section of said each spring side, the central section including a contact tab, wherein the contact tab and the outer perimeter section are capable of flexing substantially independently of each other to establish electrical contact between the conductive spring and a longitudinal conductive pin of an electronic component along the contact tab and a bottom part of the outer perimeter section, and wherein said each spring side comprises an inward-bending support tab configured to press the bottom part of the outer perimeter section outward to establish contact with the longitudinal conductive pin; and inserting the longitudinal conductive pin in the longitudinal conductive slot of the conductive support to establish the electrical contact between the conductive spring and the longitudinal conductive pin along the contact tab and outer perimeter section of the spring side.

3. A U-shaped electrical connector spring of an electrical connection assembly, the spring comprising:

a pair of conductive, generally longitudinal spring sides, each spring side having a pair of parallel longitudinal slots defined therein, the longitudinal slots separating an outer perimeter section of said each side from a central section of said each side, the central section including a contact tab configured to establish contact with an external longitudinal conductive pin of an electronic component, wherein the contact tab and the outer perimeter section are capable of flexing substantially independently of each other to establish electrical contact between the conductive spring and the external longitudinal conductive pin along the contact tab and a bottom part of the outer perimeter section, and wherein said each spring side comprises an inward-bending support tab configured to press the bottom part of the outer perimeter section outward to establish contact with the external longitudinal conductive pin; and a spring top plate interconnecting the spring sides along corresponding top regions of the spring sides.

4. The connection assembly of claim 1, wherein each of the longitudinal conductive slots has an arcuate transverse cross-section.

5. The method of claim 2, wherein the longitudinal conductive slot has an arcuate transverse cross-section.

* * * * *